US005901682A

United States Patent [19]

McGee et al.

[11] Patent Number: 5,901,682

[45] Date of Patent: May 11, 1999

[54] METHOD FOR TRANSITIONING BETWEEN DIFFERENT OPERATING MODES OF AN INTERNAL COMBUSTION ENGINE

[75] Inventors: Brian G. McGee, Chillicothe; Roberto B. Wiener, Peoria, both of Ill.

[73] Assignee: Caterpillar Inc., Peoria, Ill.

[21] Appl. No.: 08/995,072

[22] Filed: Dec. 19, 1997

[51] Int. Cl.[6] ..... F02D 41/00

[52] U.S. Cl. ..... 123/339.19; 123/486

[58] Field of Search ..... 123/492, 493, 123/339.19

[56] References Cited

U.S. PATENT DOCUMENTS

| | | | |
|---|---|---|---|
| 4,662,340 | 5/1987 | Nagano | 123/492 |
| 5,094,213 | 3/1992 | Dudek et al. | 123/339.27 |
| 5,465,700 | 11/1995 | Nishimoto | 123/492 |
| 5,492,102 | 2/1996 | Thomas et al. | 123/493 |
| 5,549,092 | 8/1996 | Hasegawa et al. | 123/492 |
| 5,666,917 | 9/1997 | Fraser et al. | 123/339.18 |

*Primary Examiner*—Erick R. Solis

*Attorney, Agent, or Firm*—M. Nieberding; R. Carl Wilbur

[57] ABSTRACT

A method for transitioning between a first engine operating mode and a second engine operating mode of an internal combustion engine involves establishing an engine mode transition region between the first engine operating mode and the second engine operating mode, which engine mode transition region is defined by at least one engine operating parameter. The engine operating parameter which defines the engine mode transition region is monitored. When the engine is operating in the transition region a first engine operating mode fuel rate is determined, a second engine operating mode fuel rate is determined, and an engine mode transition region fuel rate is determined which is a function of both the first engine operating mode fuel rate and the second engine operating mode fuel rate.

21 Claims, 5 Drawing Sheets

METHOD FOR TRANSITIONING BETWEEN DIFFERENT OPERATING MODES OF AN INTERNAL COMBUSTION ENGINE

TECHNICAL FIELD

This invention relates generally to internal combustion engine operating modes, and more particularly, to a method for providing a smooth transition between a first engine operating mode and a second engine operating mode of an internal combustion engine.

BACKGROUND ART

An internal combustion engine may operate in a variety of different modes, particularly in modern engine systems which are electronically controlled based upon a variety of monitored engine operating parameters. Some typical operating modes include a cold mode, a warm mode, a cranking mode, a low idle mode, a high idle mode, and an in-between mode which is between the low idle mode and the high idle mode. Various engine operating parameters may be monitored to determine the engine operating mode including engine speed, throttle position, vehicle speed, coolant temperature, and oil temperature, as well as others. In each operating mode it is not uncommon to use different techniques to determine the amount of fuel to deliver to the engine for a fuel delivery cycle. For example, different fuel rate maps might be utilized in two different modes or a fuel rate map might be used in one mode and in another mode an engine speed closed loop control may be used. Switching from one engine operating mode to another can therefore result in a stepped fuel rate change that exceeds a desired level and may result in undesired engine noise or vibration.

Accordingly, the present invention is directed to overcoming one or more of the problems as set forth above.

DISCLOSURE OF THE INVENTION

In one aspect of the present invention a method of providing smooth transition between a first engine operating mode and a second engine operating mode of an internal combustion engine is provided. The method involves determining a first engine operating mode fuel rate, determining a second engine operating mode fuel rate, and determining a transition fuel rate as a function of both the first engine operating mode fuel rate and the second engine operating mode fuel rate.

In another aspect of the present invention a method for transitioning between a first engine operating mode and a second engine operating mode of an internal combustion engine is provided. The method involves establishing an engine mode transition region between the first engine operating mode and the second engine operating mode, which engine mode transition region is defined by at least one engine operating parameter. The engine operating parameter which defines the engine mode transition region is monitored. When the engine is operating in the transition region a first engine operating mode fuel rate is determined, a second engine operating mode fuel rate is determined, and an engine mode transition region fuel rate is determined which is a function of both the first engine operating mode fuel rate and the second engine operating mode fuel rate.

BEST MODE FOR CARRYING OUT THE INVENTION

Figure 1:
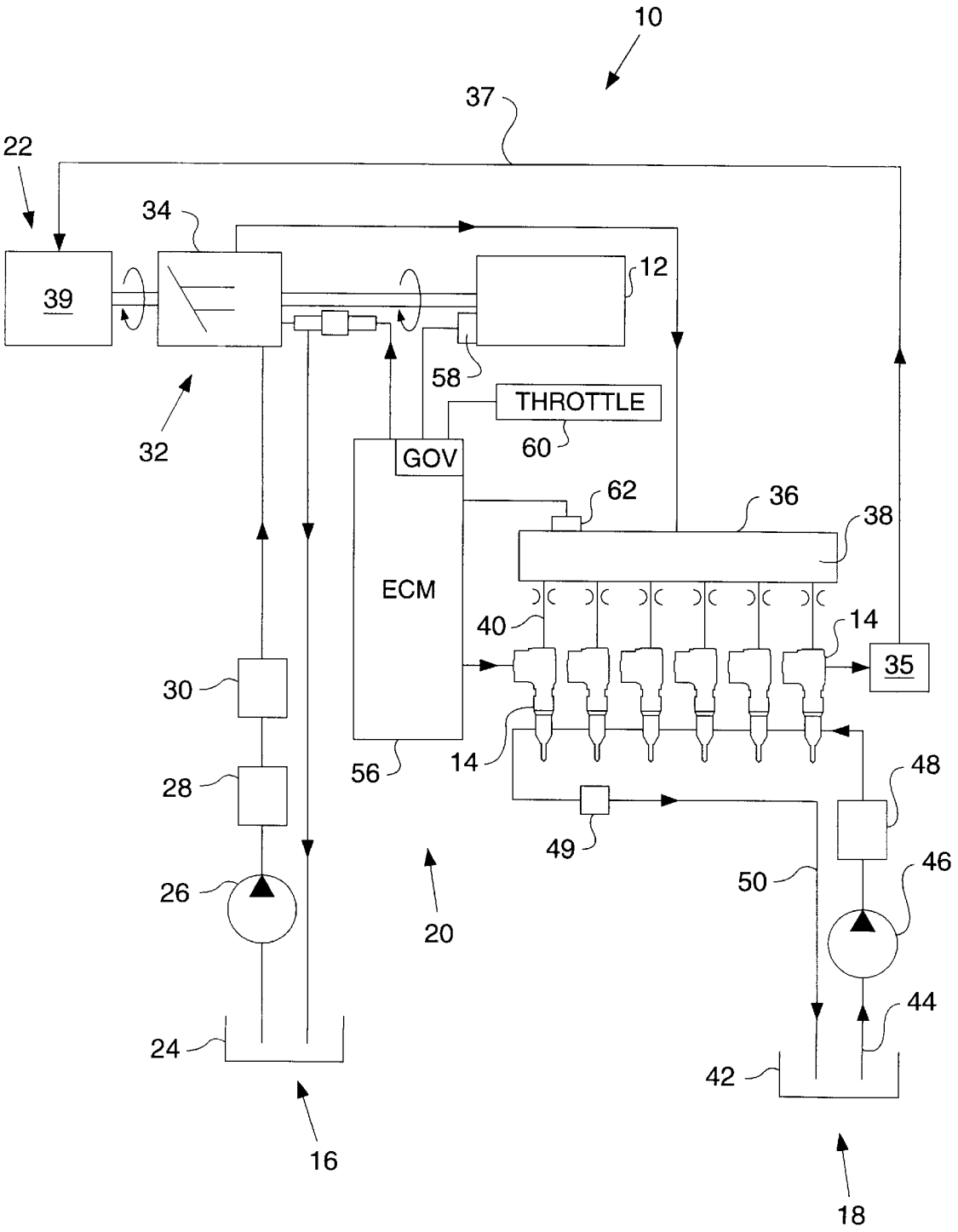
FIG. 1 is a diagrammatic general schematic view of a hydraulically-actuated electronically-controlled injector fuel system for an engine having a plurality of injectors.

Referring to FIG. 1, there is shown a hydraulically-actuated electronically-controlled fuel injector system 10 (hereinafter referred to as HEUI-B fuel system). Typical of such systems are those shown and described in U.S. Pat. No. 5,463,996, U.S. Pat. No. 5,669,355, U.S. Pat. No. 5,673,669, U.S. Pat. No. 5,687,693, and U.S. Pat. No. 5,697,342. The exemplary HEUI-B fuel system is shown in FIG. 1 as adapted for a direct-injection diesel-cycle internal combustion engine 12 in which the present invention may be utilized.

HEUI-B fuel system 10 includes one or more hydraulically-actuated electronically-controlled injectors 14, such as unit fuel injectors, each adapted to be positioned in a respective cylinder head bore of engine 12. The system 10 further includes apparatus or means 16 for supplying hydraulic actuating fluid to each injector 14, apparatus or means 18 for supplying fuel to each injector, apparatus or means 20 for electronically controlling the manner in which fuel is injected by injectors 14, including timing, number of injections, and injection profile, and actuating fluid pressure of the HEUI-B fuel system 10 independent of engine speed and load. Apparatus or means 22 for recirculating or recovering hydraulic energy of the hydraulic actuating fluid supplied to injectors 14 is also provided.

Hydraulic actuating fluid supply means 16 preferably includes an actuating fluid sump 24, a relatively low pressure actuating fluid transfer pump 26, an actuating fluid cooler 28, one or more actuating fluid filters 30, a source or means 32 for generating relatively high pressure actuating fluid, such as a relatively high pressure actuating fluid pump 34, and at least one relatively high pressure fluid manifold 36. The actuating fluid is preferably engine lubricating oil. Alternatively the actuating fluid could be fuel.

Apparatus 22 may include a waste actuating fluid control valve 35 for each injector, a common recirculation line 37, and a hydraulic motor 39 connected between the actuating fluid pump 34 and recirculation line 37.

Actuating fluid manifold 36, associated with injectors 14, includes a common rail passage 38 and a plurality of rail branch passages 40 extending from common rail 38 and arranged in fluid communication between common rail 38 and actuating fluid inlets of respective injectors 14. Common rail passage 38 is also arranged in fluid communication with the outlet from high pressure actuating fluid pump 34.

Fuel supplying means 18 includes a fuel tank 42, a fuel supply passage 44 arranged in fluid communication between fuel tank 42 and a fuel inlet of each injector 14, a relatively low pressure fuel transfer pump 46, one or more fuel filters 48, a fuel supply regulating valve 49, and a fuel circulation and return passage 50 arranged in fluid communication between injectors 14 and fuel tank 42. The various fuel passages may be provided in a manner commonly know in the art.

Electronic controlling means 20 preferably includes an electronic control module (ECM) 56, the use of which is well known in the art. ECM 56 typically includes processing means such as a microcontroller or microprocessor, associated memory, a governor (GOV) such as a proportional integral derivative (PID) controller for regulating engine speed, and circuitry including input/output circuitry and the like. ECM 56 may be used to control fuel injection timing, fuel quantity injected, fuel injection pressure, number of separate injections per injection cycle, time intervals between injection segments, and fuel quantity injected by each injection segment. Each of such parameters are variably controllable independent of engine speed and load.

Associated with a camshaft of engine 12 is an engine speed sensor 58 which produces speed indicative signals. Engine speed sensor 58 is connected to the governor of ECM 56 for monitoring of the engine speed and piston position for timing purposes. A throttle 60 is also provided and produces signals indicative of a desired engine speed, throttle 60 also being connected to the governor of ECM 56. An actuating fluid pressure sensor 62 for sensing the pressure within common rail 38 and producing pressure indicative signals is also connected to ECM 56. Such a system may also include a variety of other sensor inputs to the ECM including, for example, a vehicle speed input, a coolant temperature input, and an oil temperature input to name just a few.

Each of the injectors 14 is preferably of a type such as that shown and described in one of U.S. Pat. No. 5,463,996, U.S. Pat. No. 5,669,355, U.S. Pat. No. 5,673,669, U.S. Pat. No. 5,687,693, and U.S. Pat. No. 5,697,342. However, it is recognized that the present invention could be utilized in association with other types of injectors. Further, the present invention could be utilized in association with other types of fuel delivery systems and other types of engines, including spark-ignited engines, and that such engines could further be v-type engines, in-line engines, or rotary engines.

Figure 2:
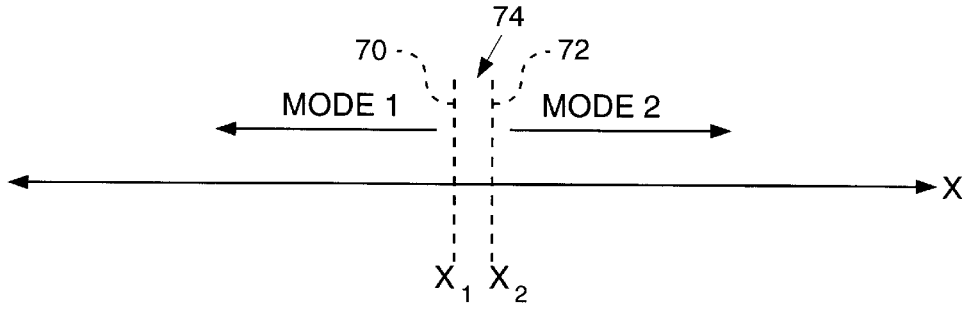
FIG. 2 is a graphical representation of different operating modes having a transition region therebetween.
Figure 3:
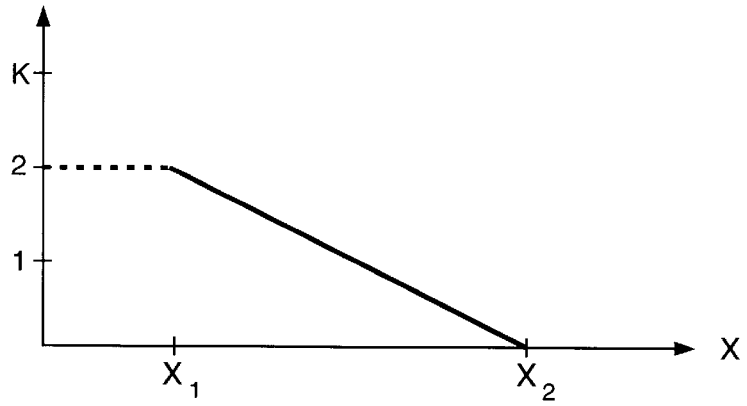
FIG. 3 is a graph depicting the value of a variable K within the transition region of FIG. 2.

Engine 12 may operate in different modes depending upon various engine operating parameters. Referring to FIG. 2, a graphical representation of two different, generic operating modes MODE1 and MODE2 relative to a generic engine operating parameter X is shown. In accordance with the present invention, as shown by dashed lines 70 and 72, a transition region 74 is established to allow for a smooth transition from operation in MODE1 to operation in MODE2. Line 70 corresponds to a parameter X value of $X_1$ and line 72 corresponds to a parameter X value of $X_2$. Within MODE1 ECM 56 determines a fuel rate $Y_{M1}$ in one manner and within MODE2 ECM 56 determines a fuel rate $Y_{M2}$ in a different manner. Within transition region 74, ECM 56 will determine a fuel rate $Y_T$ which is a function of a fuel rate $Y_{M1}$ determined in accordance with the MODE1 manner and a fuel rate $Y_{M2}$ determined in accordance with the MODE2 manner. In particular, fuel rate $Y_T$ will be determined using a weighted average transition according to the following equation:

$$Y_T=0.5[(K)*(Y_{M1})+(2-K)*(Y_{M2})],$$

where the value of K varies according to the portion of transition region 74 within which engine 12 is operating. The value of K will vary according to the actual value of monitored parameter X. As shown in FIG. 3 it is preferred that the value of K vary linearly between $X_1$ and $X_2$, however it is recognized that the value of K need not vary in a precisely linear manner. As shown, the value of K varies from two at the $X_1$ side of transition region 74 to zero at the $X_2$ side of transition region 74. Accordingly, the nearer engine operation is to MODE1, the greater the weight or contribution the MODE1 fuel rate $Y_{M1}$ will have in determining $Y_T$. Similarly, the nearer engine operation is to MODE2, the greater the weight or contribution the MODE2 fuel rate $Y_{M2}$ will have in determining $Y_T$. The value of K can be determined by ECM 56 according to the following equation:

$$K=m*X+d,$$

where $$d=-m*X_1,$$

and $$m=2/[X_2-X_1].$$

The value of K could also be determined by ECM 56 by reference to a stored map of K as a function of engine operating parameter X. Once engine operation leaves transition region 74 and enters a given mode, the fuel rate will be determined only as a function of the given mode. It is recognized that the equation for determining $Y_T$ could be manipulated so that the line defining K in FIG. 3 would be inverted. Similarly, the value of K could vary from zero to one if an appropriate scaling factor is utilized. Engine operation in accordance with the present invention can be achieved by appropriate programming of ECM 56 utilizing techniques well known to those of skill in the art.

Industrial Applicability

Use of the transition method according to the present invention prevents a step change in fuel delivery to the engine which might otherwise occur if such transition method were not utilized. Accordingly, engine noise and vibration during such mode transitions are likewise reduced.

Figure 4:
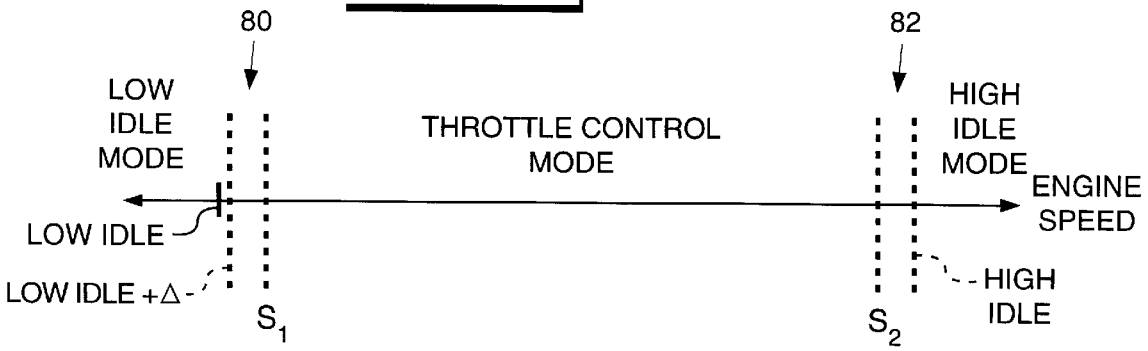
FIG. 4 is a graphical representation of a low idle mode, a throttle control mode, and a high idle mode.

By way of example, reference is made to FIG. 4 which is a graphical representation of three different engine modes including a low idle mode, a high idle mode, and an in-between mode which is identified as a throttle control mode. Engine speed, which increases from left to right in FIG. 4, is the engine operating parameter used to distinguish between the modes. Generally, in the low idle mode and the high idle mode fuel rate determination is based on an engine speed closed loop control, such as the output of the governor which is a function of actual engine speed and a desired engine speed. In the throttle control mode the fuel rate determination is an open loop determination based upon one or more fuel rate maps, such as an open loop torque map which is a function of throttle setting and engine speed and/or an open loop drivability map which is a function of throttle setting and vehicle speed. It is preferred that both fuel rate maps be utilized and that the minimum fuel rate as between the two maps be selected. However, it is recognized that other variations for using the outputs from the two different fuel rate maps are possible. Between the low idle mode and the throttle control mode a transition region 80 is established and between the high idle mode and the throttle control mode a transition region 82 is established. In particular, transition region 80 falls between an engine speed designated LOWIDLE+Δ and an engine speed designated $S_1$. Transition region 82 falls between an engine speed designated HIGHIDLE and an engine speed designated $S_2$.

Figure 5:
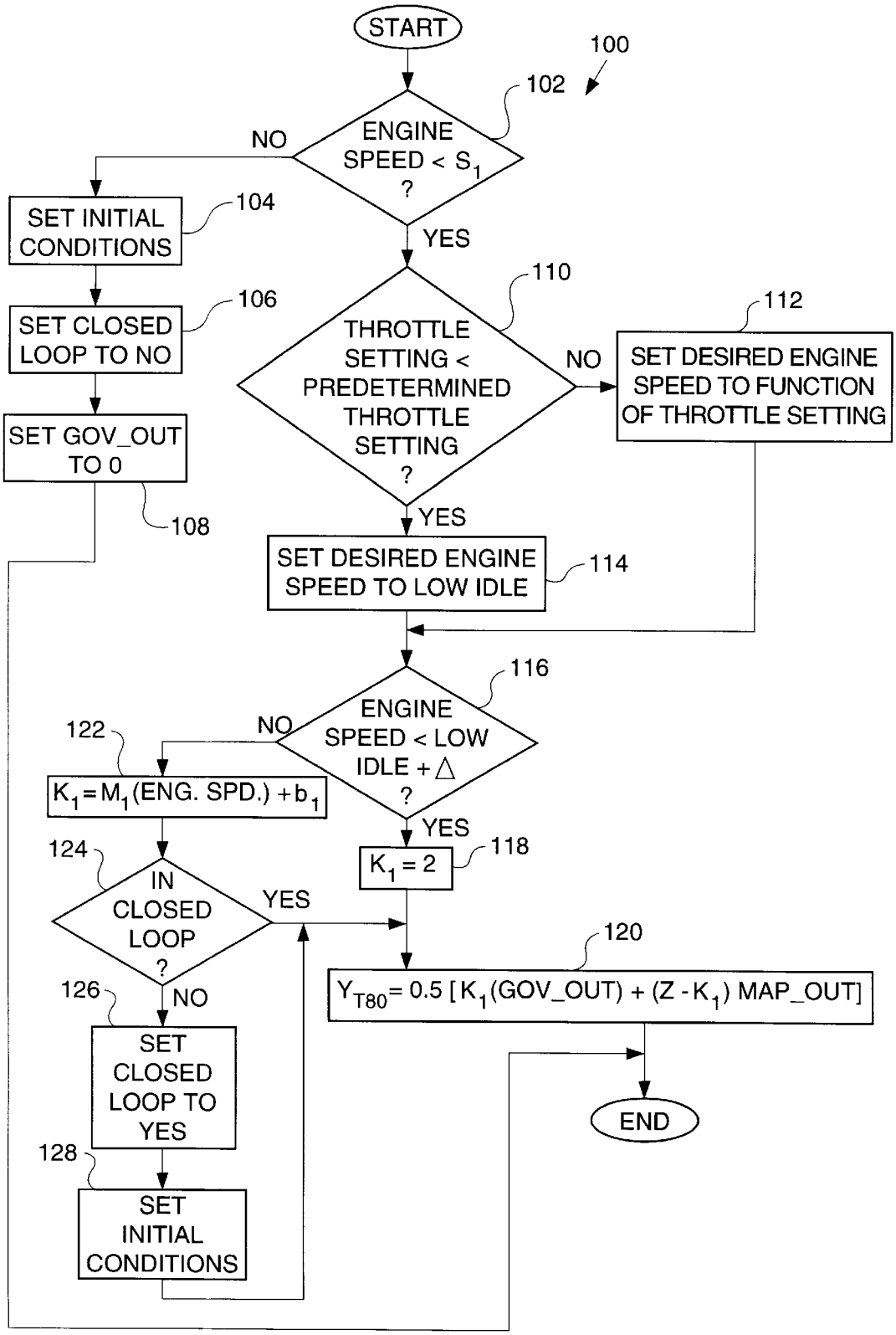
FIG. 5 is a flowchart for low idle operation.

A flowchart 100 for operation in the low idle mode and for operation in transition region 80 is shown in FIG. 5. At step 102 the actual engine speed is compared to engine speed $S_1$. If the engine speed is not less than speed S1 then the fuel rate will be determined according to the throttle control mode only and initial conditions are set at step 104, a closed loop indicator is set to no at step 106, and the governor output is set to zero at step 108. If the actual engine speed is less than speed S1 then at step 110 an actual throttle setting is compared to a predetermined throttle setting. The predetermined throttle setting is preferably selected as an indicator of whether or not a gas pedal in a vehicle is being depressed for example. If the throttle setting is greater than or equal to the predetermined throttle setting then the desired engine speed for governor purposes is set to a value which is a function of the throttle setting at step 112. If the throttle setting is less than the predetermined throttle setting then the desired engine speed is set to a value LOWIDLE at step 114. The actual engine speed is then compared to engine speed LOWIDLE+Δ at step 116 to determine if the engine is operating in transition region 80. If the engine is operating outside transition region 80, variable $K_1$ is set to a value of two at step 118 and the fuel rate $Y_{T80}$ is determined at step 120. At a $K_1$ value of two the fuel rate will be equal to the governor determined fuel rate. If the engine is operating within transition region 80, the value of variable $K_1$ is calculated at step 122. A check is then made to see if the closed loop indicator is set to yes at step 124. If the closed loop indicator is already set to yes the fuel rate $Y_{T80}$ is determined at step 120. Otherwise the closed loop indicator is set to yes at step 126, initial conditions are set at step 128, and fuel rate $Y_{T80}$ is determined at step 120.

Accordingly, in the strictly low idle mode the desired engine speed is set to a value of LOWIDLE if the throttle is not being depressed. If the throttle is being depressed the desired engine speed is set to a function of the throttle setting. In transition region 80, the fuel rate according to the governor output and the fuel rate according to the fuel rate map are both weighted and used to determine the transition fuel rate $Y_{T80}$ at step 120 in order to provide smooth transition between the two modes. The lower limit of transition region 80 is offset from the engine speed LOWIDLE by a value Δ so that the averaging method is not unnecessarily utilized where a slight overshoot of speed LOWIDLE occurs.

Figure 6:
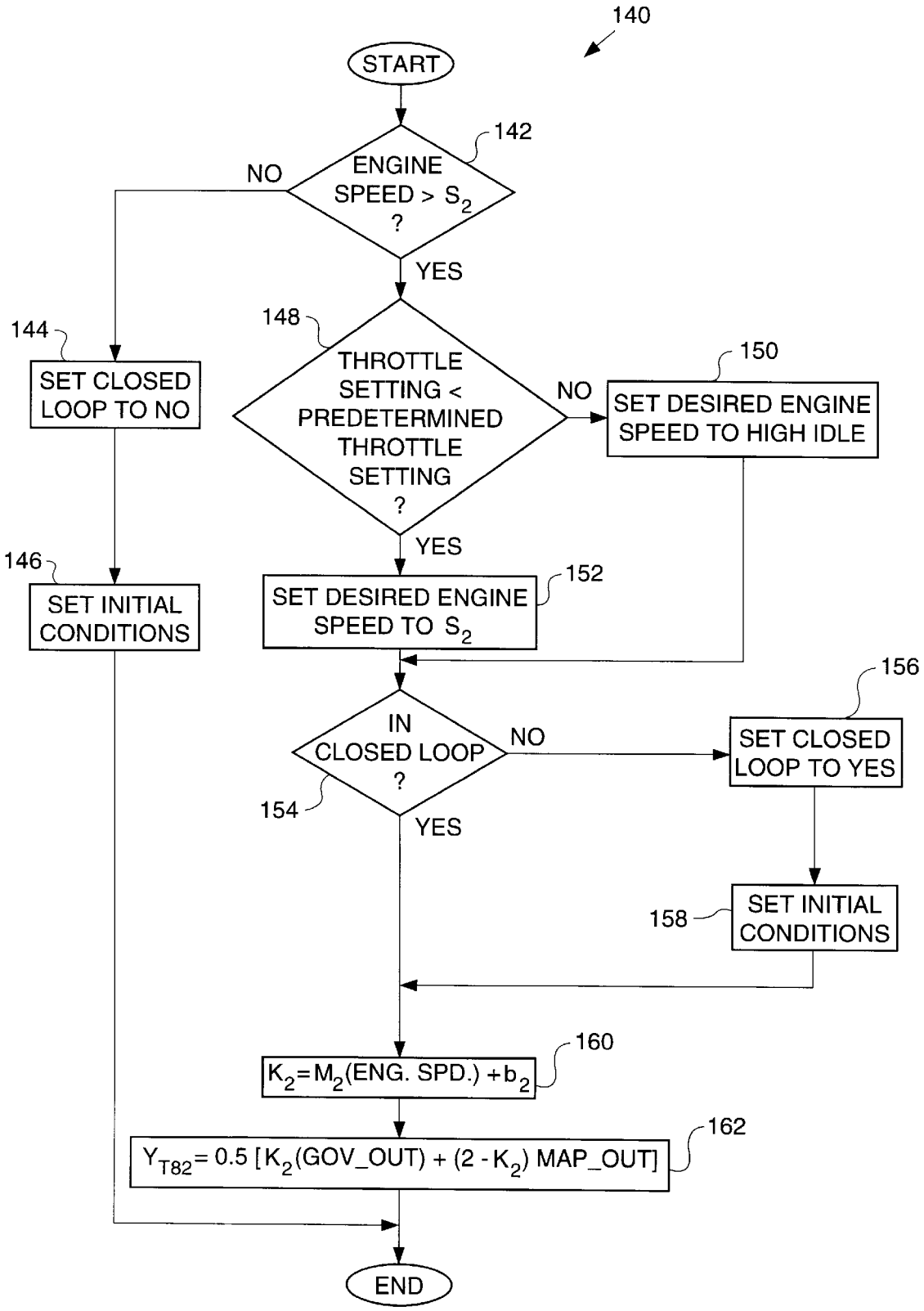
FIG. 6 is a flowchart for high idle operation.

A flowchart 140 for operation in high idle mode and for operation in transition region 82 is shown in FIG. 6. At step 142 the actual engine speed is compared to speed $S_2$. If the engine speed is not greater than speed $S_2$ then the fuel rate will be determined according to the throttle control mode only and a closed loop indicator is set to no at step 144 and initial conditions are set at step 146. If the engine speed is greater than $S_2$ the throttle setting is compared to a predetermined throttle setting at step 148. If the throttle setting is greater than or equal to the predetermined throttle setting then the desired engine speed for governor purposes is set to speed HIGHIDLE at step 150. Otherwise the desired engine speed is set to speed $S_2$ at step 152. A check is then made to see if the close loop indicator is set to yes at step 154. If the closed loop indicator is not already set to yes the closed loop indicator is set to yes at step 156 and the initial conditions are set at step 158. Otherwise the value of variable $K_2$ is determined at step 160 and fuel rate $Y_{T82}$ is determined at step 162.

Accordingly, in a strictly high idle mode the desired engine speed is set to HIGHIDLE if the throttle is being depressed. The speed HIGHIDLE should be selected as a maximum acceptable high idle speed so as to prevent engine damage. If the throttle is not being depressed the desired engine speed is set to speed $S_2$ because it is desirable to leave the high idle mode as quickly as possible. In transition region 82, the fuel rate according to the governor output and the fuel rate according to the fuel rate map are both weighted and used to determine the transition fuel rate $Y_{T82}$ at step 162 in order to provide smooth transition between the two modes.

Figure 7:
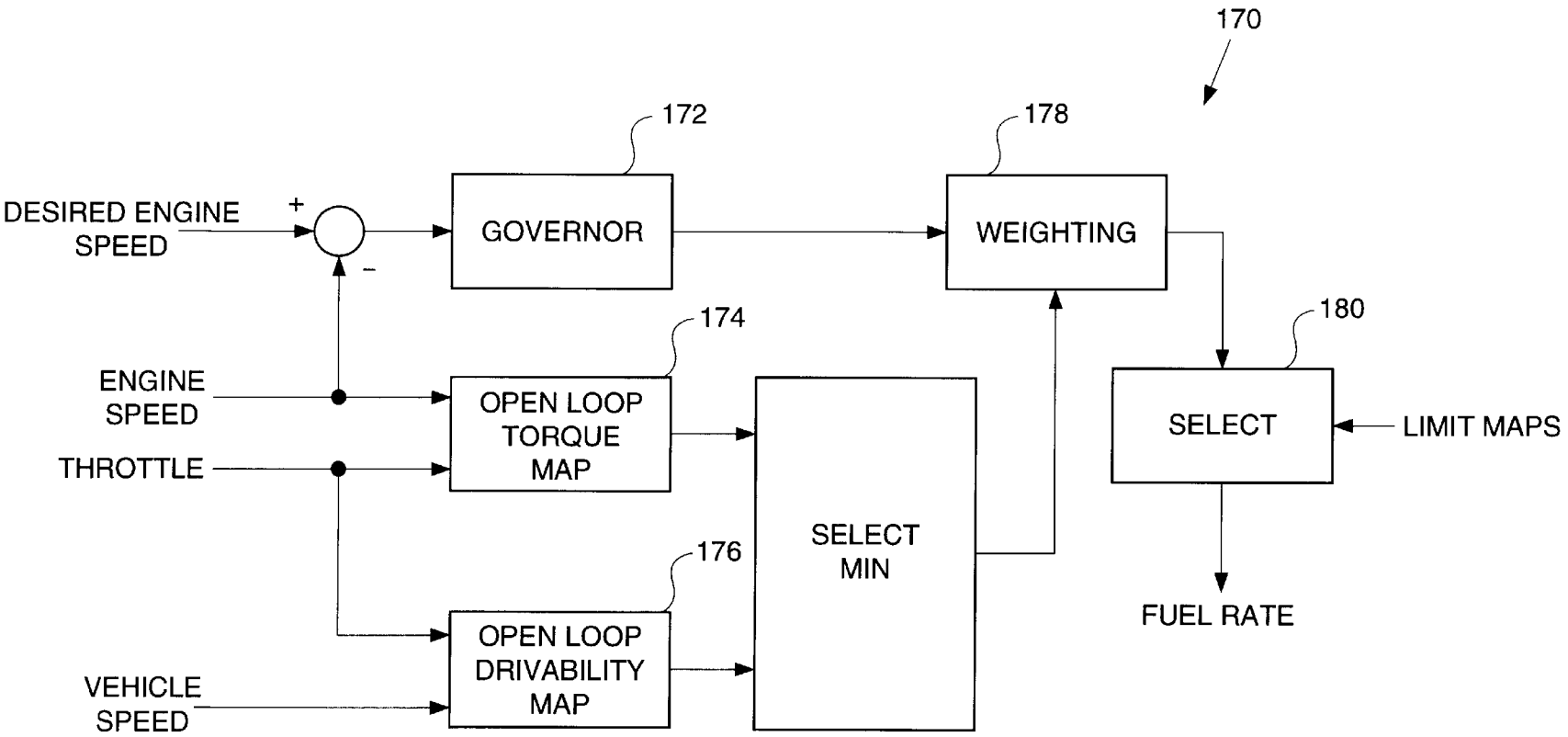
FIG. 7 is a control diagram pertaining to FIGS. 4—6.

Referring to FIG. 7, a control diagram 170 corresponding to FIGS. 4–6 is shown. The fuel rate output of governor 172 and the minimum selected fuel rate output of maps 174 and 176 are weighted at 178. The output may then be subjected to other constraints at 180, such as fuel rate limits set by a torque map or smoke map for example.

Other aspects, objects and advantages of the present invention can be obtained from a study of the drawings, the disclosure and the appended claims.

We claim:

1. A method for transitioning between a first engine operating mode and a second engine operating mode of an internal combustion engine, wherein said first engine operating mode determines fuel rate delivery from a fuel rate map and said second engine operating mode calculates fuel rate delivery in a closed loop control, the method comprising the steps of:

(a) establishing an engine mode transition region between the first engine operating mode and the second engine operating mode, which engine mode transition region is defined by at least one engine operating parameter, (b) monitoring the engine operating parameter which defines the engine mode transition region; and (c) performing the following steps within the engine mode transition region:

(i) determining a first engine operating mode fuel rate from said fuel rate map;

(ii) determining a second engine operating mode fuel rate from said closed loop control; and (iii) determining an engine mode transition region fuel rate which is a function of both the first engine operating mode fuel rate and the second engine operating mode fuel rate.

2. The method, as set forth in claim 1, wherein step (c) includes:

(iv) delivering a fuel amount which corresponds to the engine mode transition region fuel rate.

3. The method, as set forth in claim 1, wherein the engine operating parameter which defines the engine mode transition region is engine speed.

4. The method, as set forth in claim 1, wherein in step (c)(iii) the first engine operating mode fuel rate and the second engine operating mode fuel rate are each weighted according to what portion of the engine mode transition region the engine is operating within.

5. The method, as set forth in claim 4, wherein the first engine operating mode fuel rate has a value $Y_{M1}$, the second engine operating mode fuel rate has a value $Y_{M2}$, and the engine mode transition region fuel rate has a value $Y_T$, and in step (c)(iii) the engine mode transition region fuel rate is determined in accordance with the following equation:

$$Y_T=0.5*[(K)*(Y_{M1})+(2-K)*(Y_{M2})],$$

wherein the value of K is determined as a function of the engine operating parameter which defines the engine mode transition region.

6. The method, as set forth in claim 5, wherein the value of K varies linearly over the engine mode transition region.

7. The method, as set forth in claim 1, wherein the first engine operating mode is a low idle mode in which fuel rate is controlled by a desired engine speed and the second engine operating mode is a throttle controlled mode in which fuel rate is determined as a function of at least a throttle setting.

8. The method, as set forth in claim 7, wherein step (c)(i) involves:

comparing a throttle setting to a predetermined throttle setting;

setting the desired engine speed to a predetermined low idle speed if the throttle setting is below the predetermined throttle setting; and setting the desired engine speed to a value which is a function of at least the throttle setting if the throttle setting is above the predetermined throttle setting.

9. The method, as set forth in claim 1, wherein the first engine operating mode is a high idle mode in which fuel rate is controlled by a desired engine speed and the second engine operating mode is a throttle controlled mode in which fuel rate is determined as a function of at least a throttle position.

10. The method, as set forth in claim 9, wherein step (c)(i) involves:

comparing a throttle setting to a predetermined throttle setting;

setting the desired engine speed to a predetermined high idle speed if the throttle setting is above the predetermined throttle setting; and setting the desired engine speed to a predetermined speed which is less than the predetermined high idle speed if the throttle setting is below the predetermined throttle setting.

11. A method of providing smooth transition between a first engine operating mode and a second engine operating mode of an internal combustion engine, each of said first and second engine operating modes determining a fuel rate from a different fuel delivery rate map or a different closed loop calculation, the method comprising the steps of:

(a) determining a first engine operating mode fuel rate;

(b) determining a second engine operating mode fuel rate; and (c) determining a transition fuel rate as a function of both the first engine operating mode fuel rate and the second engine operating mode fuel rate.

12. The method, as set forth in claim 11, including the step of:

(d) delivering a fuel amount to the engine which corresponds to the transition fuel rate.

13. The method, as set forth in claim 12, including the steps of:

(e) sensing an engine parameter which is indicative of engine operating mode; and (f) determining if the sensed engine parameter falls within a predetermined range.

14. The method, as set forth in claim 13, wherein the sensed engine parameter is engine speed.

15. The method, as set forth in claim 11, wherein step (c) involves:

multiplying the first engine operating mode fuel rate by a first weight value; and multiplying the second engine operating mode fuel rate by a second weight value.

16. The method, as set forth in claim 15, wherein the first weight value and the second weight value are both a function of a sensed engine parameter.

17. The method, as set forth in claim 11, wherein the first engine operating mode fuel rate is determined as a function of a desired engine speed and the second engine operating mode fuel rate is determined as a function of at least a throttle position.

18. The method, as set forth in claim 11, wherein the first engine operating mode fuel rate is established by a governor of a fuel injection system of the engine and the second engine operating mode fuel rate is established by a map which is a function of at least a throttle setting.

19. The method, as set forth in claim 11, wherein the engine is a diesel-cycle fuel injected engine.

20. A method for transitioning between a first engine operating mode and a second engine operating mode of an internal combustion engine, wherein said first engine operating mode determines a fuel rate delivery from a first fuel rate map and said second engine operating mode determines a fuel rate delivery from a second fuel rate map the method comprising the steps of:

(a) establishing an engine mode transition region between the first engine operating mode and the second engine operating mode, which engine mode transition region is defined by a predetermined range of values of at least one engine operating parameter, (b) monitoring the engine operating parameter which defines the engine mode transition region; and (c) performing the following steps within the engine mode transition region:

(i) determining a first engine operating mode fuel rate from said first fuel rate map;

(ii) determining a second engine operating mode fuel rate from said second fuel rate map;

(iii) determining an engine mode transition region fuel rate which is a function of both the first engine operating mode fuel rate and the second engine operating mode fuel rate; and (iv) varying said engine mode transition region fuel rate as a function of said engine operating parameter to avoid stepped fuel rate changes.

21. A method of transitioning from one engine operating mode to a second engine operating mode, wherein said engine operating modes produce a fuel rate command as a function of an engine operating parameter, and wherein said fuel rate produced by said first engine operating mode for a given value of the engine operating parameter is different from said fuel rate produced by said second engine operating mode for the same value of said engine operating parameter, comprising:

determining a value of said engine operating parameter;

determining a first fuel rate of said first engine operating mode corresponding to said value of said engine operating parameter;

determining a second fuel rate of said second engine operating mode corresponding to said value of said engine operating parameter;

producing a difference between said first fuel rate to said second fuel rate; and calculating a transitional fuel rate as a function of said first and second fuel rate in response to the magnitude of said difference exceeding a predetermined tolerance.

* * * * *